United States Patent [19]

Kosson et al.

[11] 4,019,571

[45] Apr. 26, 1977

[54] GRAVITY ASSISTED WICK SYSTEM FOR CONDENSERS, EVAPORATORS AND HEAT PIPES

[75] Inventors: Robert L. Kosson, Massapequa; John A. Quadrini, Northport, both of N.Y.

[73] Assignee: Grumman Aerospace Corporation, Bethpage, N.Y.

[22] Filed: Oct. 31, 1974

[21] Appl. No.: 519,788

[52] U.S. Cl. ..... 165/105; 122/366

[51] Int. Cl.² ..... F28D 15/00

[58] Field of Search ..... 165/105; 138/40, 44; 122/366

[56] References Cited

UNITED STATES PATENTS

| | | | |
|---|---|---|---|
| 3,720,988 | 3/1973 | Waters | 165/105 X |
| 3,734,173 | 5/1973 | Moritz | 165/105 |
| 3,901,311 | 8/1975 | Kosson et al. | 165/105 |

*Primary Examiner*—Albert W. Davis, Jr.

*Attorney, Agent, or Firm*—Morgan, Finnegan, Pine, Foley & Lee

[57] ABSTRACT

A wick system is disclosed comprising a casing, a wall capillary and a mesh screen wick having at least one artery structure used in conjunction with a closed or open system while in contact with the wall capillary. The wick system may be used in a vertical or inclined position with a condenser at the top.

27 Claims, 7 Drawing Figures

GRAVITY ASSISTED WICK SYSTEM FOR CONDENSERS, EVAPORATORS AND HEAT PIPES

BACKGROUND OF THE INVENTION

The present invention relates to a wick system for use in evaporators, condensers and heat pipes and more specifically to a wick system operating in a gravity environment.

Conventional heat pipes include closed chambers which contain a wick and an evaporable working fluid. When the pipe is heated at one end, for example, the fluid vaporizes in the area of the heat, generating an increase in pressure which urges the vapor to flow to the cooler end of the pipe. The vapor is condensed in the condenser region and is returned through the wick to the evaporator region by capillary action. Thus, heat applied at any point along its length can be distributed throughout the pipe. Ideally, the heat is distributed with only a small temperature drop along the pipe.

These heat pipes usually operate with an appreciable internal pressure determined by the vapor pressure of the working fluid. In addition, they generally require capillary integrity of the artery surface for longitudinal liquid flow within the artery and often require spacer means to maintain the proper spacing between the screen layers to keep the proper fluid flow.

SUMMARY OF THE INVENTION

It is therefore an object of the present invention to provide a wick system which enables high heat transfer over small temperature differentials.

It is another object of the present invention to provide a wick system which generates high film coefficients of heat transfer while operating in a gravity environment.

It is still a further object of the present invention to provide a wick system in which the liquid flowing down the condenser surface is very thin to provide a high film coefficient, and consequently, a high condensation rate.

It is a further object of this invention to provide a low cost wick system which does not require capillary integrity.

It is still another object to provide a wick system which does not require spacing means between layers of wire mesh.

According to the present invention, a wick system is provided for use in a gravity environment, in a vertical or inclined orientation. This wick system can be used in an open or closed evaporator-condenser system and is capable of use in such devices as heat pipes and large area heat exchangers. It is particularly useful where high film coefficients are required at small temperature differences.

The present wick system consists of at least one artery comprising a plurality of screen mesh layers and includes means for urging the artery toward the wall of an evaporator-condenser system. The artery or arteries are formed with a central canal having a prescribed diameter such that condensate liquid flows continuously through the canal without overfilling such that a self-priming siphon is formed. Advantageously, the wick is formed with two artery structures by rolling both edges of a single mesh screen into spiral arteries. In the preferred embodiment of the present invention, the two arteries are rolled in opposite directions vis-a-vis the web portion which remains after the rolling, such that the resulting wick has a substantially S-shape with curled ends and at least one layer of screen mesh is added to the wick adjacent the web portion to provide rigidity to the wick system and extra biasing to urge the arteries against the inner wall.

In operation, the wick system is in contact with the walls of the evaporator-condenser or heat pipe system. Vapors condense on the walls of the condenser and the condensed liquid flows from a wall capillary on the inner wall — preferably grooves therein — to the artery structure by means of capillary forces. The condensate liquid quickly penetrates to the canal in the artery where it is attracted downward under the influence of gravity. A self-priming siphon of continuously flowing liquid is thereby formed drawing further liquid from the wall to hasten the cycle of the system. When the liquid reaches the evaporator, it flows by capillary action through the layers of screen mesh back to the wall of the evaporator where it vaporizes and travels to the condenser section where the cycle repeats.

When operating in a vertical position with the condenser portion at the top, a heat pipe utilizing this wick system exhibits a higher heat transfer at a given temperature drop — about 450 watts at a temperature drop of about 4° F — than designs previously known. The operation of the present invention relies on gravity rather than capillary forces for longitudinal flow of liquid within the artery. Capillary forces are needed only for liquid flow between the wall capillary and the wick and vice versa and therefore capillary integrity is unnecessary, permitting a much simpler and cheaper wick. Since the gravity head is one to two orders of magnitude larger than the capillary head, a smaller diameter canal than in convenional wicks is required. It has been found that the present invention provides high film coefficients of heat transfer. Furthermore, compared with conventional wick systems, the liquid film on the condenser surface is much thinner, permitting higher condensation rates for given temperature differences. The present invention also offers an advantage over conventional pool boiling evaporators in that higher rates of evaporation are obtained when temperature differences between wall and vapor are small and the evaporation takes place by vaporization at the liquid-vapor interface rather than at surface nucleation sites.

These and other objects, features and advantages of the present invention will become apparent from the detailed description of the preferred embodiments.

BRIEF DESCRIPTION OF THE DRAWINGS

The detailed description may be taken in conjunction with the accompanying drawings, in which.

DETAILED DESCRIPTION OF THE INVENTION

Figure 1A:
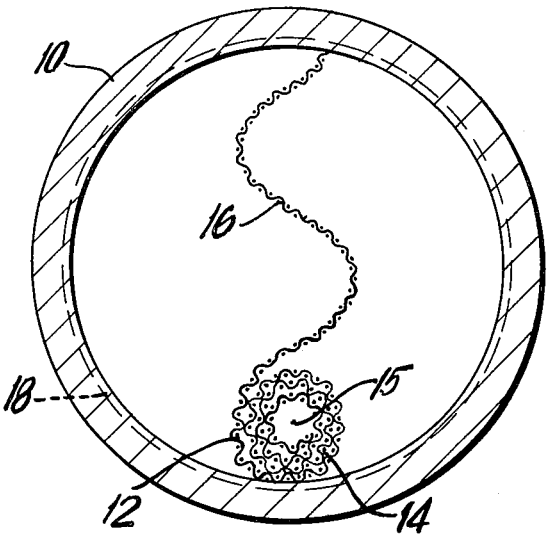
FIG. 1*a*, 1*b* and 1*c* represent cross-sectional views of evaporator-condenser systems utilizing a wick system according to the present invention.

Referring to FIG. 1*a*, one embodiment of the present invention, includes wick system 12 which comprises multilayered artery structure 14, canal 15 defined therein, and biasing means, 16, to urge artery 14 against wall capillary 18 formed on the inner wall of casing 10. A vaporizable liquid (not shown) is contained within the casing. Advantageously, the biasing means may be a web of the screen mesh extending from the artery. Extra biasing may be supplied by placing additional layers of screen mesh adjacent the web as described in conjunction with FIG. 1*c*.

Figure 1B:
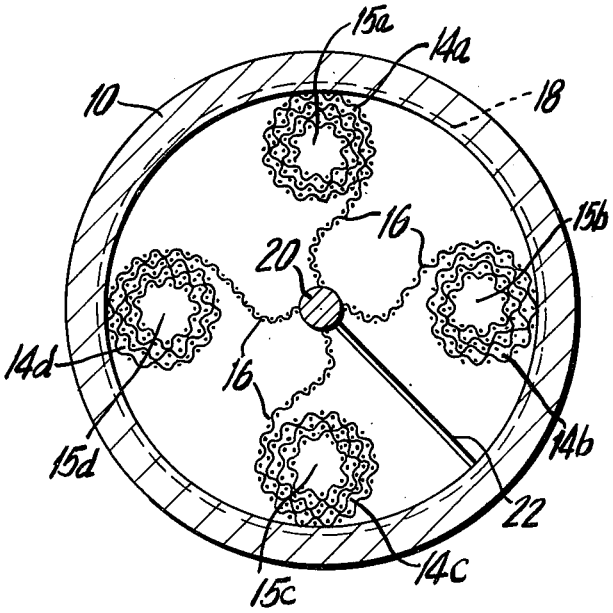

In FIG. 1*b*, an alternate embodiment of the present invention includes a plurality of wound screen mesh arteries, 14*a*, 14*b*, etc. having canal portions, 15*a*, 15*b*, etc. respectively, formed therein. Biasing means 16 associated with each artery urges each artery against wall capillary 18. Advantageously, biasing means 16 are affixed to support member 20 to ensure an even distribution of forces imparted to the arteries. Support member 22 may be rigidly set with respect to the casing by using rib members 22 spaced along its length.

Figure 1C:
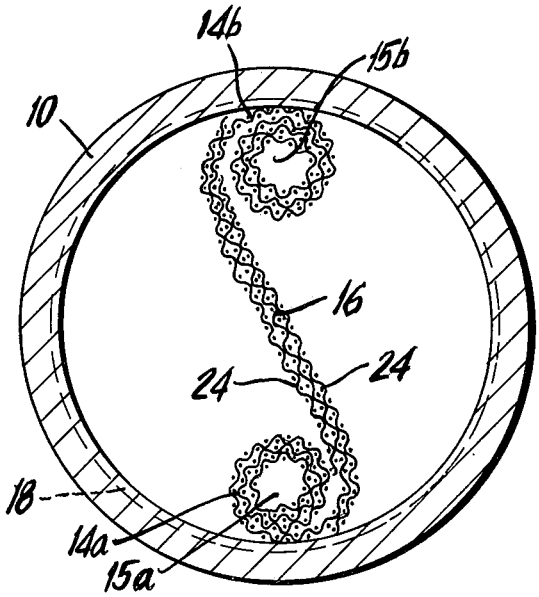
Figure 2:
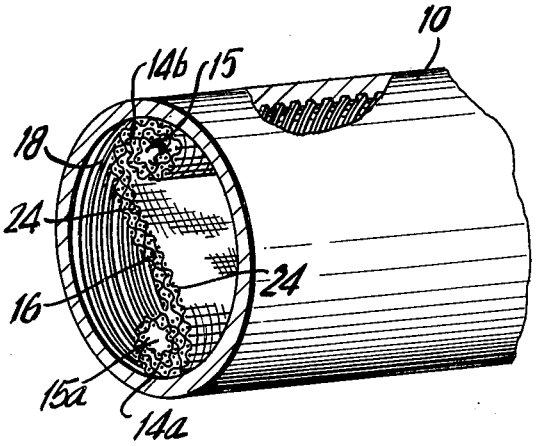
FIG. 2 is an interior view showing the wall capillary as a grooved surface on the inner wall of the casing.

Referring now to FIG. 1*c* and 2, the preferred wick structures include artery structures 14*a* and 14*b* comprising a plurality of screen mesh layers defining canals 15*a* and 15*b* respectively. The arteries are connected by and integral with web section 16 to urge them against wall capillary 18 and are formed by rolling the two edges of a single layer of mesh screen. Advantageously, the two edges of the mesh screen are rolled in opposite directions with respect to each other, as shown in FIG. 2, so that they are on opposite sides of the web in a substantially S-shape, either backward or forward, with curled ends. Preferably, additional layers of screen mesh, 24, are placed about the web, as shown in FIG. 1*c* to add structural rigidity to web 16 and to further bias the arteries against the wall capillary. Advantageously, these layers 24 can be placed with one edge against the inner casing wall and the other abutting the web portion substantially at the point where it joins the artery structure to enhance its biasing effect.

The wick structure is placed inside the casing such that the two arteries abut the inner wall of the casing. In a particularly useful configuration, the two arteries will contact the wall capillary at two points which are substantially diametrically opposite each other. The return of condensate liquid to the evaporator is thereby hastened since the liquid will travel the shortest distance, on the average, along the capillary to reach one of the arteries. The wall capillary can be screening in contact with the inner wall or, preferably, it comprises a grooved inner casing wall. Furthermore, the artery screen mesh preferably ranges from about 50 to about 350 mesh stainless steel woven wire screen.

In the preferred form, the diameter of the canal within the artery is sized such that during operation it is substantially filled with condensed vaporizable liquid which flows downwardly through the canal, 15, in the artery under the influence of gravity. Thus, when the canal is neither overfilled nor underfilled, the condensed vaporizable liquid will flow continuously through the canal as a self-priming siphon.

To determine the proper diameter of the canal, the viscous losses in the fluid and the gravity head acting on the liquid should hold the following relationship:

$$\Delta P_{viscosity} \leqq \Delta P_{gravity}$$

Solving for the diameter, $d$, of the canal, $$d = 4\sqrt{\frac{2\mu V}{(\rho_l - \rho_v)\, g \cos\theta}}$$

where $\mu$ is the absolute viscosity of the liquid; V is the mean velocity of liquid; $\rho_l$ is the density of the liquid; $\rho_v$ is the density of the vapor; $g$ is the acceleration due to gravity; and $\theta$ is the angle between the pipe axis and the vertical.

Therefore, the diameter of the canal can be designed with the anticipated flow of liquid per unit time. If more than one artery is to be employed, the velocity of flow in each artery will be reduced and the diameter can be reduced as indicated by the formula. The diameter should not be too large, since a void may be created in the flow so that the artery acts like an umprimed siphon. As indicated in the formula, if the wick system is used in inclined orientation, the artery diameter can be increased by dividing by the cosine of the angle between the inclined wick and the vertical.

The wick system according to the present invention can be used in an open or closed evaporator-condenser system. When the casing containing the wick system is used as an evaporator, vaporizable liquid supplied to the top of the artery flows down through the artery canal under the influence of gravity. The liquid is drawn from the artery into the grooves of the casing due to capillary forces. The liquid then coats the inner wall from which it evaporates when heat is applied. When the casing is used as a condenser, vapors condense on the cooler inner wall. Condensed liquid flows into and along the grooves in the wall toward and into the artery due to capillary forces. The liquid then flows down the artery canal to the bottom of the condenser under gravity forces.

The wick system according to the present invention is particularly useful when employed in a heat pipe. In operation the heat pipe is a closed system in which the vaporizable liquid coats the entire inner wall of the casing. Advantageously, the heat pipe has an elongated linear casing which operates in either a vertical or an inclined position for gravity assistance. Heat is applied at or near the bottom of the heat pipe which causes the liquid to evaporate, making that portion of the structure the evaporator of the heat pipe. The vapors travel along the heat pipe toward the cooler end of the heat pipe which thereby becomes the condenser portion of the heat pipe. The vapors condense on the wall capillary which directs the condensed liquid to the wick. The artery sections of the wick absorb the liquid under the influence of capillary forces and conduct the liquid downward through the artery's canal, with the assistance of gravity, to the evaporator. In the evaporator, the liquid flows from the wick to the wall capillary, where evaporation occurs and the process repeats.

Referring again to FIG. 2, there is shown a heat pipe having the preferable wall capillary comprising a grooved inner wall surface. Advantageously, the grooves are cut such that the distance between two adjacent lands is about 10 mils and the distance between the peak of a land to the valley of an adjacent groove is about 5 mils. In operation, the heated vapors travel up the pipe toward the cooler and where these vapors condense on the lands between the grooves. The condensate liquid flows into the grooves which direct the liquid to the wick. The wick arteries then conduct the liquid downward with the assistance of gravity to the evaporator. The liquid then flows from the wick to the grooves of the inner wall where evaporation occurs and the process repeats. Accordingly, the effective liquid thickness on the wall of the condenser is in the order of magnitude of $2 \times 10^{-3}$ inches.

The grooves may be in the form of concentric rings, but in a particularly useful arrangement, the grooves may be a continuous spiral. Thus, when the vapor condenses on the lands between the grooves, it will flow more quickly to the wick since, under the influence of gravity, the spiral grooves will urge the liquid downward.

Figure 3:
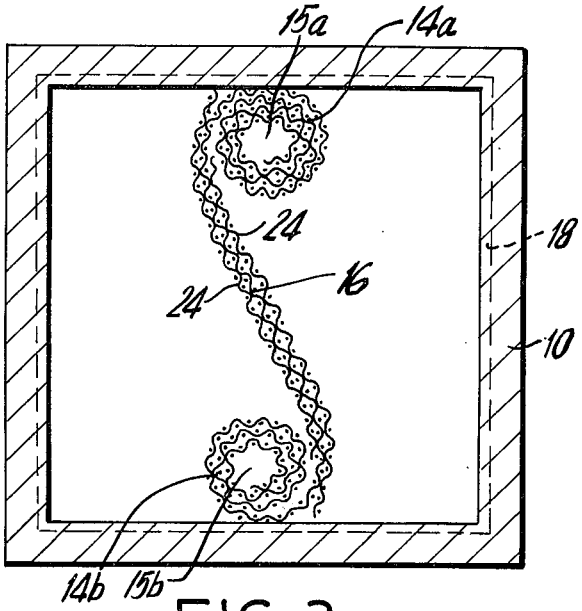
FIG. 3 is a cross-sectional view of a heat pipe in accordance with the present invention which is substantially square in cross-section.
Figure 4:
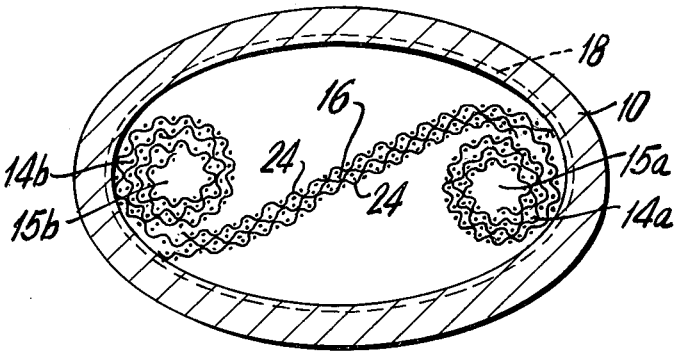
FIG. 4 is a cross-sectional view of a heat pipe in accordance with the present invention which is substantially ovoid in cross-section.
Figure 5:
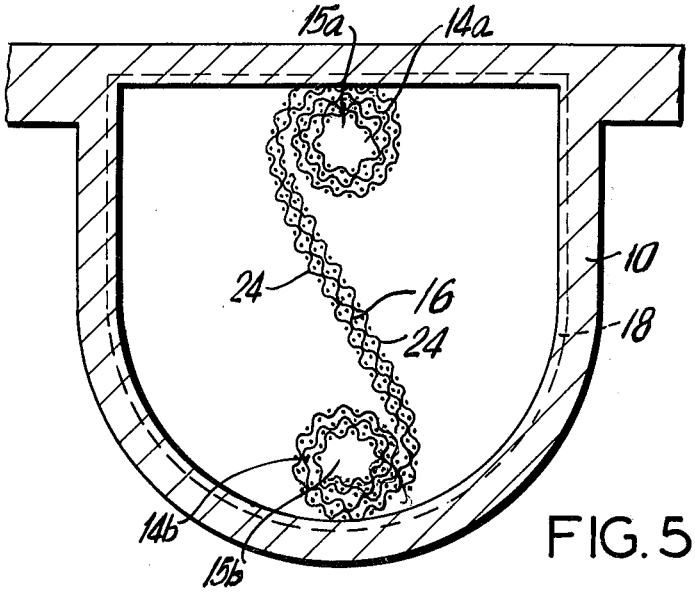
FIG. 5 is a cross-sectional view of a heat pipe in accordance with the present invention having one flat side.

From the foregoing, it can be appreciated that the present invention as shown in FIGS. 3–5 operates in substantially the same manner as described above. It should be understood that the embodiments shown are only exemplary and that various modifications can be made in construction and arrangement which do not depart from the scope and spirit of the invention as defined in the appended claims.

What is claimed is:

1. A wick system for use in a suitable casing capable of acting as an evaporator, a condenser or a conduit therebetween in a gravity environment in vertical and inclined orientations, comprising:

a casing having an outer wall and an inner wall;

a wall capillary in contact with the inner wall of said casing;

at least one artery structure comprising a plurality of generally unspaced-apart screen mesh layers defining a canal substantially central to said artery structure; and biasing means for urging said artery structure toward and in contact with the wall capillary, such that when said casing functions as an evaporator, vaporizable liquid flowing downwardly through said canal under the influence of gravity flows outwardly to said wall capillary due to capillary forces, said liquid evaporating when said casing is heated, and, such that when said casing functions as a condenser, vapors of said liquid condensing on said inner wall travel along said wall capillary toward and into said artery structure due to capillary forces, said condensed liquid flowing downwardly through said canal under the influence of gravity.

2. A wick system in accordance with claim 1 wherein the canal in said artery is adapted to receive and accommodate substantially all of said condensed vaporizable liquid to produce a siphon effect such that said condensed vaporizable liquid flows substantially continuously through said artery structure and does not overfill with liquid.

3. A wick system in accordance with claim 2 wherein said biasing means is a web of screen mesh extending from the artery to the inner wall of the casing substantially opposite the inner wall abutted by the artery.

4. A wick system in accordance with claim 3 which includes at least one additional layer of screen mesh adjacent said web to provide extra biasing.

5. A wick system in accordance with claim 2 which comprises two artery structures and wherein said biasing means comprises a web section connecting said two arteries.

6. A wick system in accordance with claim 5 wherein said artery structures and said web section are formed from one continuous mesh screen, each edge of which is rolled into a spiral artery structure.

7. A wick system in accordance with claim 6 wherein the edges of said continuous mesh screen are rolled so that the arteries are on substantially opposite sides of the web section.

8. A wick system in accordance with claim 7 which further includes at least one additional layer of screen mesh adjacent said web to provide extra biasing.

9. A wick system in accordance with claim 8 wherein said wall capillary comprises a grooved inner wall and wherein said layers of screen mesh are made of from about 50 to about 350 mesh stainless steel woven wire screen.

10. A wick system in accordance with claim 8 wherein said wall capillary comprises screening in contact with said inner wall and wherein said layers of screen mesh are made of from about 50 to about 350 mesh stainless steel woven wire screen.

11. A wick system in accordance with claim 2 which further includes a plurality of said artery structures, a support member positioned generally central of said casing, and, wherein said biasing means comprises a web of screen mesh extending from each of said artery structures to said support member.

12. A wick system in accordance with claim 11 which further includes a plurality of rib members affixed between the inner wall of said casing and said support member for rigidly positioning said support member generally central of said casing.

13. A heat pipe for use in a gravity environment in a vertical and an inclined orientation comprises:

a closed casing having an inner wall and an outer wall;

a wall capillary in contact with the inner wall of said casing;

a vaporizable liquid contained in said casing;

an arterial wick structure of mesh screen within said casing comprising at least one spirally wound artery structure formed of a plurality of generally unspaced-apart mesh screen layers defining a canal in said artery structure;

biasing means for urging said artery structure toward and in contact with the wall capillary, such that when said vaporizable liquid is evaporated near a first end of said casing and condenses near a second end of said casing on said inner wall, condensed vaporizable liquid flows along said wall capillary toward and into said artery structure due to capillary forces and condensed liquid returns through said canal to said first end under influence of gravity.

14. A heat pipe according to claim 13 wherein the canal in said artery structure is adapted to receive and accommodate substantially all of said condensed vaporizable liquid to produce a siphon effect such that said condensed vaporizable liquid flows substantially continuously through said artery structure and does not overfill with liquid.

15. A heat pipe in accordance with claim 14 wherein said biasing means is a web of screen mesh extending from said artery structure to the inner wall of the casing substantially opposite the inner wall abutted by the artery.

16. A heat pipe in accordance with claim 15 which includes at least one additional layer of screen mesh adjacent said web to provide extra biasing.

17. A heat pipe in accordance with claim 14 which comprises two artery structures and wherein said biasing means comprises a web section of screen mesh connecting said two artery structures.

18. A heat pipe in accordance with claim 17 wherein said artery structures and said web layer are formed from one continuous mesh screen, each edge of which is rolled into a spiral artery structure.

19. A heat pipe in accordance with claim 18 wherein the edges of the continuous mesh screen are rolled so that they are on opposite sides of the web.

20. A heat pipe in accordance with claim 19 which further includes at least one additional layer of screen mesh adjacent said web.

21. A heat pipe in accordance with claim 20 wherein said wall capillary comprises a grooved inner wall and wherein said layers of screen mesh are made of from about 50 to about 350 mesh stainless steel woven wire screen.

22. A heat pipe in accordance with claim 21 wherein said grooved inner wall comprises a continuous spiral groove on the inner wall, said groove having adjacent lands spaced about 10 mils apart and said groove being about 5 mils deep.

23. A heat pipe in accordance with claim 20 wherein said wall capillary comprises screening in contact with said inner wall and wherein said layers of screen mesh are made of from about 50 to about 350 mesh stainless steel woven wire screen.

24. A heat pipe in accordance with claim 20 wherein the heat pipe is substantially circular in cross-section.

25. A heat pipe in accordance with claim 20 wherein the heat pipe has a cross-section with at least one flat side.

26. A heat pipe in accordance with claim 14 which further includes a plurality of said artery structures, a support member positioned generally central of said casing, and, wherein said biasing means comprises a web of screen mesh extending from each of said artery structures to said support member.

27. A heat pipe in accordance with claim 26 which further includes a plurality of rib members affixed between the inner wall of said casing and said support member for rigidly positioning said support member generally central of said casing.

* * * * *